US009025808B2

(12) United States Patent
Kwon et al.

(10) Patent No.: US 9,025,808 B2
(45) **Date of Patent: *May 5, 2015**

(54) HIGH-OUTPUT MICROSPEAKER

(75) Inventors: Joong Hak Kwon, Gyeongsangbuk-do (KR); Cheon Myeong Kim, Gyeongsangnam-do (KR); Ji Hoon Kim, Gyeongsangnam-do (KR); Kyu Dong Choi, Gyeongsangnam-do (KR)

(73) Assignee: Em-Tech. Co., Ltd., Busan (KR)

( * ) Notice: Subject to any disclaimer, the term of this patent is extended or adjusted under 35 U.S.C. 154(b) by 0 days.
This patent is subject to a terminal disclaimer.

(21) Appl. No.: 14/116,197

(22) PCT Filed: May 10, 2012

(86) PCT No.: PCT/KR2012/003653
§ 371 (c)(1),
(2), (4) Date: Nov. 7, 2013

(87) PCT Pub. No.: WO2012/157888

PCT Pub. Date: Nov. 22, 2012

(65) Prior Publication Data

US 2014/0169593 A1 Jun. 19, 2014

(30) Foreign Application Priority Data

May 13, 2011 (KR) ..... 10-2011-0045070

(51) Int. Cl.
*H04R 25/00* (2006.01)
*H04R 9/04* (2006.01)

(52) U.S. Cl.
CPC ..... *H04R 9/043* (2013.01); *H04R 9/045* (2013.01)

(58) Field of Classification Search
USPC ..... 381/162, 398, 403, 404, 409, 410, 423, 381/431; 181/157, 161, 164, 171, 172, 173; 29/594, 609.1
See application file for complete search history.

(56) References Cited

U.S. PATENT DOCUMENTS 8,794,374 B2 * 8/2014 Kim et al. ..... 381/398
2006/0098838 A1 * 5/2006 Yoo ..... 381/398

(Continued)

FOREIGN PATENT DOCUMENTS

KR 10-0930537 12/2009
KR 100963559 B1 6/2010

(Continued)

OTHER PUBLICATIONS

International Preliminary Report on Patentability for International Application PCT/KR2012/003653 (Nov. 19, 2013).

(Continued)

*Primary Examiner* — Huyen D Le
(74) *Attorney, Agent, or Firm* — Murphy, Bilak & Homiller, PLLC

(57) ABSTRACT

The present invention relates to a high-output microspeaker, and more particularly, to a high-output microspeaker which includes a damper for preventing lateral vibrations of a diaphragm. The present invention discloses a high-output microspeaker, comprising: a frame; a protector; a yoke assembly coupled to the frame and including a magnet; a diaphragm provided in the frame and producing vibration; a voice coil coupled to the diaphragm and vibrating the diaphragm; a terminal provided on one side of the frame and providing an electrical connection between the lead wire of the voice coil and an external terminal; and a damper formed of an FPCB that includes an inner portion to which a center diaphragm, a side diaphragm and the voice coil are attached, an outer portion to which the side diaphragm is attached and which is in contact with the frame and the protector, a support portion functioning to connect the voice coil, the outer portion and the inner portion and including a land portion to which the lead-in wire of the coil is soldered or welded, and a connecting portion extending outward from the outer portion and providing an electrical connection between the terminal provided on the frame and the outer portion.

15 Claims, 8 Drawing Sheets

(56) References Cited

U.S. PATENT DOCUMENTS

| | | | | |
|---|---|---|---|---|
| 2013/0161122 | A1* | 6/2013 | Kim | 181/157 |
| 2014/0119578 | A1* | 5/2014 | Choi et al. | 381/162 |

FOREIGN PATENT DOCUMENTS

| | | | |
|---|---|---|---|
| KR | 10-2010-0121771 | | 11/2010 |
| KR | 20100121771 | A | 11/2010 |
| KR | 10-2011-0002370 | | 1/2011 |
| KR | 20-2011-0002043 | | 3/2011 |
| WO | 2011/027995 | | 3/2011 |

OTHER PUBLICATIONS

International Search Report for International Application No. PCT/KR2012/003653 (Nov. 9, 2012).

* cited by examiner

HIGH-OUTPUT MICROSPEAKER

TECHNICAL FIELD

The present invention relates to a high-output microspeaker, and more particularly, to a high-output microspeaker which includes a damper for preventing lateral vibrations of a diaphragm.

BACKGROUND ART

Conventional microspeakers did not use wideband sound sources due to the limitations of communication technology. However, with the advancement of information and communication technology, the bandwidth of a sound source to be reproduced by a speaker has become wider and the required output has increased. Thus, a conventional microspeaker structure has its limitations in terms of features and reliability.

FIG. 1 is a sectional view showing a conventional sound transducer.

As shown, a typical sound transducer (speaker) includes a frame 1, a yoke 2 inserted and mounted inside the frame 1, an inner ring magnet 3 and an outer ring magnet 4 for transmitting a magnetic flux to the yoke 2 or receiving the magnetic flux from the yoke 2, an inner ring top plate 5 and an outer ring top plate 6 for receiving the magnetic flux from the inner ring magnet 3 or the outer ring magnet 4 and transmitting the magnetic flux to a voice coil 7 at a right angle, the voice coil 7 partially inserted into air gaps between the inner ring magnet 3 and inner ring top plate 5 and the outer ring magnet 4 and outer ring top plate 6, a diaphragm 8, into which the voice coil 7 is attached, for generating a vibration by the up-down movement of the voice coil 7, and a protector 10 having a sound-emitting hole 11 and protecting the diaphragm 8.

The lead-out wire of the voice coil 7 is fixedly adhered to the bottom face of the diaphragm 8 by a wire bond, taken out through the side face of the frame 1 or a groove (not shown) formed at the frame 1, and soldered to a terminal 14 along the outer side face of the frame 1, respectively.

However, this structure has limitations in reproducing wideband sound sources. When it comes to a single film type diaphragm, if a film with low rigidity is used or the diaphragm is thinned, in order to improve low frequency performance, this generates dips in sound pressure at mid-to-high frequencies and particular lateral vibrations at low frequencies, thus causing an increase in defect rate. On the other hand, if the diaphragm is thickened or a film with high rigidity is used, this degrades low frequency performance and results in poor sound balance. For this reason, a film structure for a wideband speaker was conventionally proposed, in which an edge portion and a central portion are made of different film materials.

However, this structure also produces severe lateral vibrations at high-output mode, and can even cause coil breakage, which may lead to serious problems in terms of reliability. Accordingly, a structure using a damper was conventionally proposed to solve these problems.

The components and shape of this damper greatly affect the features and reliability of a microspeaker when configuring the damper. A wrongly-configured damper could be more subject to wire breakage than a voice coil lead-out structure and cause difficulties in correcting lateral vibrations at a particular mode.

DISCLOSURE OF THE INVENTION

An object of the present invention is to provide a high-output microspeaker which includes a damper having a structure capable of correcting lateral vibrations of the high-output microspeaker.

Another object of the present invention is to provide a high-output microspeaker which improves reliability by preventing the breakage of an FPCB pattern formed on a damper.

According to an aspect of the present invention for achieving the above objects, there is provided a high-output microspeaker comprising: a frame; a protector; a yoke assembly coupled to the frame and including a magnet; a diaphragm provided in the frame and producing vibration; a voice coil coupled to the diaphragm and vibrating the diaphragm; a terminal provided on one side of the frame and providing an electrical connection between the lead wire of the voice coil and an external terminal; and a damper formed of an FPCB that includes an inner portion to which a center diaphragm, a side diaphragm and the voice coil are attached, an outer portion to which the side diaphragm is attached and which is in contact with the frame and the protector, a support portion functioning to connect the voice coil, the outer portion and the inner portion and including a land portion to which the lead-in wire of the coil is soldered or welded, and a connecting portion extending outward from the outer portion and providing an electrical connection between the terminal provided on the frame and the outer portion.

In addition, the terminal and the connecting portion are located on a corner of the frame, two or more projections for supporting the connecting portion are provided on the corner where the terminal and the connecting portion are located, and the connecting portion has a shape fitting to the projections.

Moreover, the connecting portion includes a horseshoe-shaped land portion for soldering or welding.

Additionally, the horseshoe-shaped land portion is formed on at least one of the top and bottom sides of the damper.

Furthermore, the horseshoe-shaped land portion is formed on the bottom side of the damper, and a through hole for transmitting electrical signals to an FPCB pattern formed on the top side of the damper is formed at the boundary between the connecting portion and the outer portion.

Still furthermore, an FPCB pattern at the support portion is formed on either the top side or bottom side of the damper, and an FPCB pattern at the outer portion is formed on both the top and bottom sides of the damper.

Still furthermore, the inner portion has no FPCB pattern of the damper.

Still furthermore, a cover layer is formed in stress-concentrated regions of the FPCB pattern of the damper.

Still furthermore, the support portion has an FPCB pattern for soldering or welding the lead-in wire of the coil, and the FPCB pattern at the support portion includes a dummy pattern for forming a symmetrical structure.

Still furthermore, the high-output microspeaker is formed in a rectangular shape, and the support portion is formed on four edges.

Still furthermore, the support portion includes an outer curved portion, a linear portion and an inner curved portion and is connected from the outer portion to the inner portion.

Still furthermore, the width of the curved portions is greater than the width of the linear portion.

Still furthermore, the curved portion connected to the outer portion is inclined to one side from the center of the edge.

Still furthermore, the FPCB pattern of the damper includes a pair of sections, each including two neighboring support portions, and the curved portion of any one of the two support portions is spaced apart from the outer portion of the other section of the FPCB pattern.

Still furthermore, the width of the inner portion is greater than the sum of the size of the seating portion of the side diaphragm and the size of the attachment portion of the voice coil.

Still furthermore, the contour of the land portion formed at the support portion is entirely in the shape of a curve.

The high-output microspeaker provided by the present invention can prevent lateral vibrations owing to the position and shape of the support portion of the damper and the patterning shape of an FPCB pattern.

In addition, the high-output microspeaker provided by the present invention can prevent the breakage of a patterned FPCB circuit by forming a cover layer in stress-concentrated regions, thereby improving reliability.

BEST MODE FOR CARRYING OUT THE INVENTION

Figure 1:
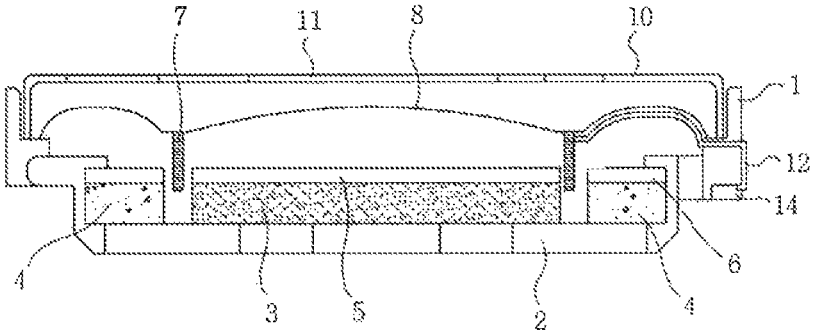
FIG. 1 is a sectional view showing a conventional sound transducer.
Figure 2:
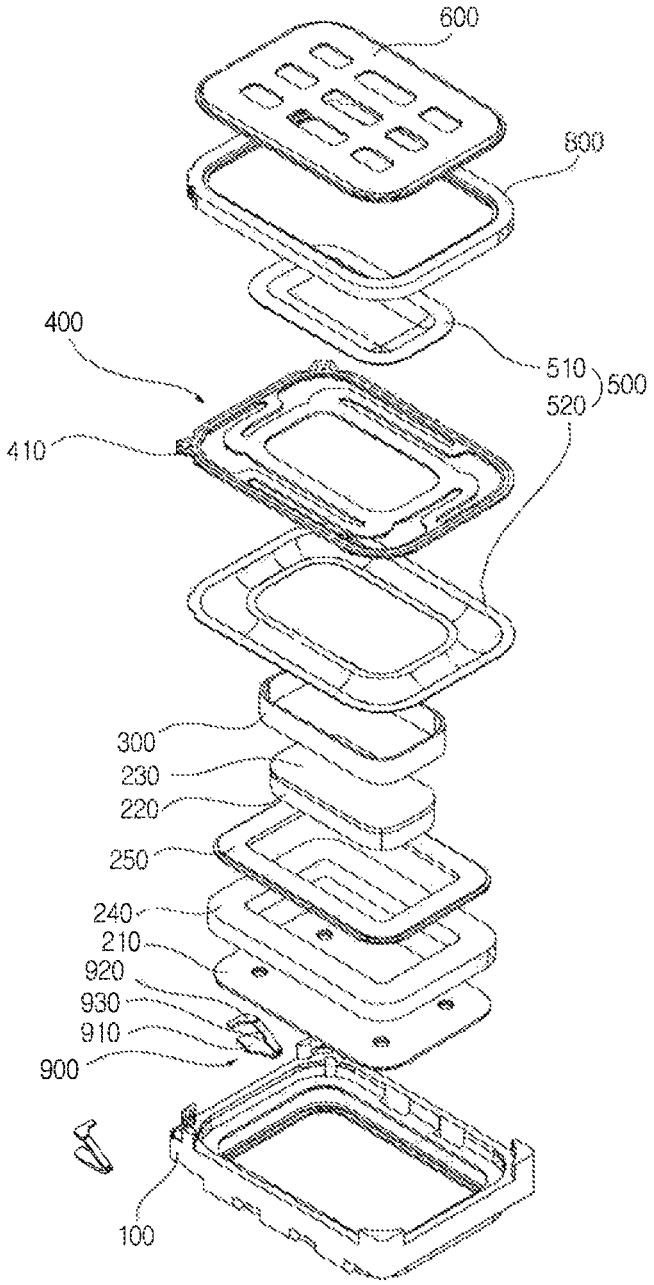
FIG. 2 is an exploded perspective view showing a sound transducer according to a first embodiment of the present invention.

FIG. 2 is an exploded perspective view showing a sound transducer according to a first embodiment of the present invention. The sound transducer according to the first embodiment includes a frame 100, a yoke 210 coupled to the bottom side of the frame 100, an inner ring magnet 220 attached to the yoke 210, an inner ring top plate 230 covering the inner ring magnet, an outer ring magnet 240 fixed to the frame 100 and the yoke 210, an outer ring top plate 250 covering the outer ring magnet 240, a voice coil 300 partially inserted between the inner ring magnet 230 and the outer ring magnet 240 and vibrating up and down according to an electrical signal, a damper 400 to which the voice coil 300 is attached and which vibrates together with the voice coil 300, a diaphragm 500 attached to the top or bottom of the damper 400 and vibrating together with the damper 400, a protector 600 that protects the internal parts, is coupled to the frame 100 to form the outer appearance, and defines an inner vibration space, and pad type terminals 900, which are an example of terminals, attached to the bottom of the frame 100 and providing connection points to an external terminal. The sound transducer further includes a short-circuit prevention member 800 interposed between the damper 400 and the protector 600. Hereinbelow, the term 'external terminal' refers to a portion or part that is provided in a machine equipped with a high-output sound transducer to transmit an electrical signal to the high-output sound transducer, and the term 'terminal' refers to a portion or part that is electrically connected to an external terminal to transmit an electrical signal to an FPCB, i.e., the damper 400. In the first embodiment of the present invention, the pad type terminals 900 are employed as an example of terminals.

The damper 400 is formed of an FPCB which is capable of transmitting an external electrical signal to the voice coil 300. The damper 400 formed of an FPCB is patterned to transmit (+) and (−) currents, with the voice coil 300 being connected to one end of the pattern and an external terminal being connected to the other end. Hereinbelow, portions that connect the damper 400 and the terminal are referred to as connecting portions 410.

The voice coil 300 is attached to the damper 400 by soldering or the like, and the diaphragm 500 is then attached to the damper 400 with tape or other adhesives. With the use of the damper 400, the diaphragm 500 vibrates up and down only, so that abnormal vibrations such as split vibrations or lateral vibrations are prevented and sound quality is improved. The diaphragm 500 includes a center diaphragm 520 located at the center and a side diaphragm 520 located outside the center diaphragm 510 and formed in a ring shape. The center diaphragm 510 and the side diaphragm 520 are in the shape of a dome, each of which projects upward or downward. The center diaphragm 510 and the side diaphragm 520 generally project upward; if the overall height of the voice coil 300 becomes larger, the lower space of the damper 400 can be used as a vibration space. Accordingly, the height (size) of the high-output sound transducer can be reduced by projecting the center diaphragm 510 and the side diaphragm 520 downward. The center diaphragm 510 and the side diaphragm 520 may be attached to the top of the damper 400 or to the bottom thereof. In the drawing, the center diaphragm 510 is illustrated as being attached to the top of the damper, and the side diaphragm 520 is illustrated as being attached to the bottom of the damper. In this case, the connecting portions 410 of the damper 400 are disposed so as not to overlap the diaphragm 500 and located on the edge of the damper 400 to provide a convenient connection to a pad type terminal 900. That is, the connecting portions 410 are located outside the region of the damper 400 to which the side diaphragm 520 is attached, so that the side diaphragm 520 and the connecting portions 410, which are mounted on the edge of the damper 400, do not overlap each other. Accordingly, 15 the outer circumference of the damper 400 is longer than the outer circumference of the side diaphragm 520. With this configuration, the damper 400, the diaphragm 500, and the voice coil 300 are joined together in a jig. They can be firmly joined because they are fixed by applying constant pressure during bonding.

Next, the voice coil 300, the side diaphragm 520 and the center diaphragm 510 are attached to the damper 400, and the damper 400 is then seated on the frame 100 where the yoke 210, the inner ring magnet 220, the inner ring top plate 230, the outer ring magnet 240, the outer ring top plate 250 and the pad type terminal 900 are mounted. The frame 100 includes projections (not shown) for helping seat the damper 400 and the diaphragm 500, and one end of the pad type terminal 900 is located at a region where the connecting portion 410 is seated. The projections 110 are located on the corners of the frame 100. Specifically, two or more projections 110 are formed on at least one corner so as to prevent the damper 400, the diaphragm 500 and the protector 600 from deviating up, down, left, and right. Preferably, the projections 110 are formed on the corners where the connecting portions 410 of the damper 400 are located, and the protector 600 has portions formed to engage with the projections 110 so that the protector 600 is fixed by the projections 110. After the damper 400 is seated on the frame 100, the damper 400 can be easily connected to the pad type terminal 900 by soldering or the like. Since the connection is established with the damper 400 seated on the frame 100, this makes the connection more solid.

Each pad type terminal 900 is insert injection-molded into the frame 100 and includes a pad portion 910 that comes into contact with an external terminal and receives an electrical signal, a bonding portion 920 that is bonded to a connecting portion 410 of the damper 400 formed of an FPCB, and a bent portion 930 connecting the bonding portion 920 and the pad portion 910. The pad portion 910 is disposed so as to be exposed to the bottom side of the frame 100 to be in contact with the external terminal, and the bonding portion 920 is disposed so as to be exposed to a top corner of the frame 100 to be in contact with the connecting portion 410 of the damper 400. In order to integrally form the frame 100 and the pad type terminal 900 by insert injection-molding, the pad type terminal 900 should be fixed into a mold so that the pad type terminal 900 is located at a precise position, i.e., no defect is generated. While the pad portion 910 of the pad type terminal 900 requires no fixing member because it is located on the bottom side of the mold, the bonding portion 920 is spaced apart from the bottom side of the mold and therefore needs to be fixed at a precise position because, unless the bonding portion 920 is at a precise position during injection molding, the bonding portion 920 could be buried in an injection-molded product and not exposed to the outside, resulting in the production of defective products incapable of bonding. Injection molding should be carried out while fixing the bonding portion 920 at a precise position by applying pressure from the top and bottom. The bonding portion 920 can be easily pressed with a separate member because its top is open. On the other hand, the pad portion 910 exists on the same axis as the bottom of the bonding portion 920, and therefore the pad portion 910 and the bonding portion 920 should be formed not to overlap each other to apply pressure to the bonding portion 920 from the bottom. Accordingly, the pad portion 910 and the bonding portion 920 should be formed in a way that the end of the bonding portion 920 does not overlap the pad portion 910 when viewed in the height direction of the high-output sound transducer (lamination direction of parts such as the frame, the magnets, the damper, etc). The bonding portion 920 may be partially extended to be longer than the pad portion 910, and the pad portion 910 may be partially eliminated.

The short-circuit prevention member 800 interposed between the damper 400 and the protector 600 will be further explained. The purpose of the protector 600 is to protect the voice coil 300, the damper 400 and the diaphragm 500 and generally has a sound-emitting hole perforated therein to emit a sound. The protector 600 is usually made of a metal because it requires sufficient strength for protection. If the protector 600 is formed of a metal, it may be brought into contact with a terminal 700 or 900 or the damper 400 formed of an FPCB, leading to short-circuit and failure. To prevent this, the short-circuit prevention member 800 made of a non-metal material is interposed between the damper 400 and the protector 600. The short-circuit prevention member 800 is formed in the shape of a rectangular ring so as to be in contact with the circumference of the protector 600 and prevents the protector 600 from coming into contact with the damper 400 or the terminal 700 or 900. The short-circuit prevention member 800 is formed integrally with the protector 600 as the protector 600 made of a metal is insert injection-molded. Instead of providing the short-circuit prevention member 800, the protector 600 may be formed of a non-conductive material.

Figure 3:
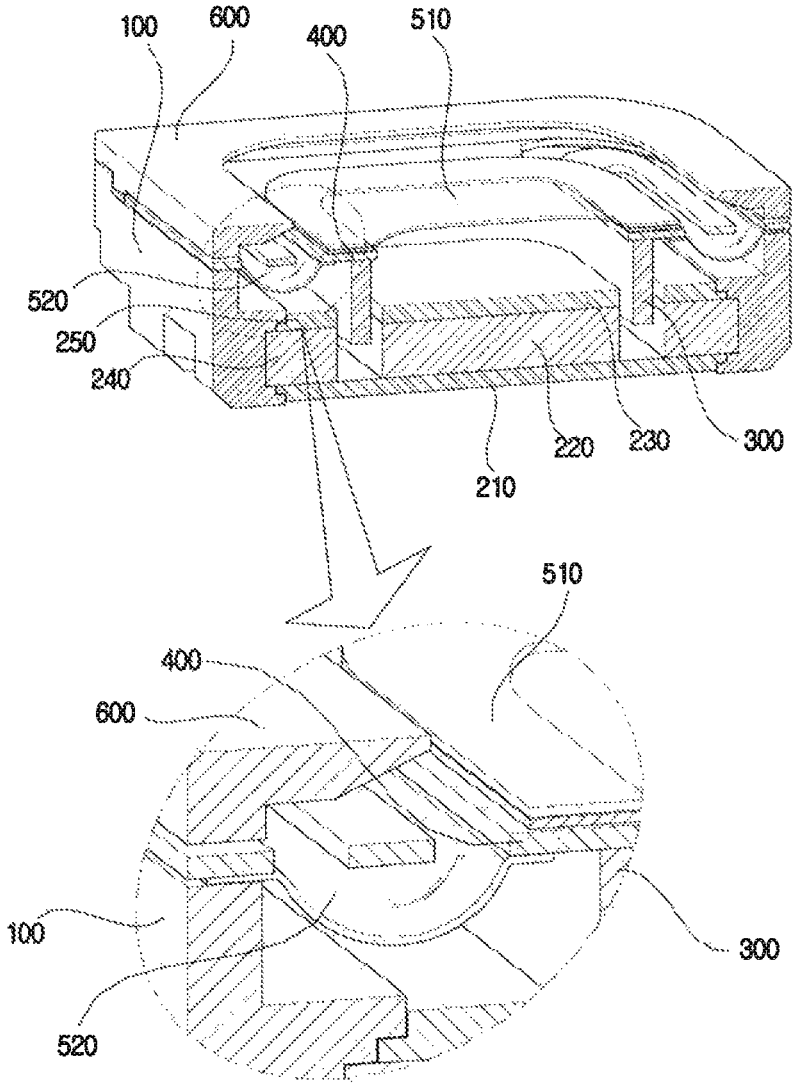
FIG. 3 is a sectional perspective view showing a sound transducer according to an embodiment of the present invention.

FIG. 3 is a sectional perspective view showing a sound transducer according to an embodiment of the present invention.

Referring to FIG. 3, a voice coil 300 and a diaphragm 500 are attached to a damper 400. As described above, the diaphragm 500 includes a center diaphragm 510 and a side diaphragm 520, and the center diaphragm 510 and the side diaphragm 520 are in the shape of a dome that projects upward or downward. In the case of a sound transducer that requires high output, as the number of turns of the voice coil 300 increases, the height of the voice coil 300 inevitably rises. Also, the projecting height of the side diaphragm 520 is increased in order to enhance low frequencies. If the voice coil 300 is attached to the bottom and the side diaphragm 520 projects upward, the overall height of the sound transducer becomes larger. If the side diaphragm 520 projects downward, the side diaphragm 520 can vibrate within a space secured for the attachment and vibration of the voice coil 300, thus providing an advantage in miniaturizing the entire sound transducer. The center diaphragm 510 may project either upward or downward because a space provided on the top by the protector 600 can be used as the vibration space, or if the diaphragm 500 is not covered with the protector 600, a space between the high-output sound transducer and a case in which the high-output sound transducer is installed can be used as the vibration space.

When the sound transducer is in operation, current flows through the voice coil 300 and generates heat. Accordingly, the side diaphragm 520 mounted on the same side as the voice coil 300 needs to be protected from heat generation. This is because the side diaphragm 520, which is made of a thin film and is weak to heat, can be easily deformed. Therefore, when attaching the voice coil 300 to the damper 400 by soldering or the like and attaching the side diaphragm 520 to the damper 400 via an adhesive or adhesive tape, the side diaphragm 520 is spaced a predetermined distance from the attachment position of the voice coil 300. Accordingly, the side diaphragm 520 can be protected from heat generated from the voice coil 300 during the operation of the sound transducer.

Meanwhile, the center diaphragm 510 and the side diaphragm 520 may be made of the same film material or different film materials as required. The center diaphragm 510 is made of a thermoplastic film such as PE, PP, PEN, PEI, PEEK or PET, and if necessary, can be UV-molded or the like. Also, the side diaphragm 520 can be made by combining a thermoplastic film such as PE, PP, PEN, PEEK, PEI or PET and a thermoplastic urethane film such as TPU. The center diaphragm 510 and the side diaphragm 520 cover different sound frequency bands. That is, the side diaphragm 510 can enhance the acoustic properties in the low frequency band owing to its increased ductility and elasticity, whereas the center diaphragm 510 can enhance the acoustic characteristics in the mid and high frequency bands owing to its light weight and increased rigidity.

Referring again to FIG. 3, it can be seen that the outer ring top plate 250 and the frame 100 have level differences so as to engage with each other. If the outer ring top plate 250 and the frame 100 have level differences to engage with each other, less space is required to fix the outer ring top plate 250 and the frame 100, as compared to the outer ring top plate 250 and the frame 100 which do not. More specifically, the top of the outer ring top plate 250 should be covered with the frame 100 so as to fix the outer ring top plate 250 and the outer ring magnet 240. By providing level differences in the outer ring top plate 250 and the corresponding level differences in the frame 100, the height of the frame 100 projecting above the outer ring top plate 250, which is required for fixing the outer ring top plate 250, can be reduced. With the reduction of the height (space) required to fix the outer ring top plate 250 and the frame 100, if the sound transducer is mounted in a space of the same size, the space for vibration of the diaphragm can be further extended, thereby helping improve the output of the sound transducer and providing an advantage in miniaturizing the sound transducer. Besides, a leakage magnetic flux flowing from the outer ring magnet 240 toward the frame 100 can be reduced, and therefore the amount of the magnetic flux flowing between the outer ring magnet 240 and the inner ring magnet 220 can be increased, thus improving the output of the sound transducer.

Figure 4:
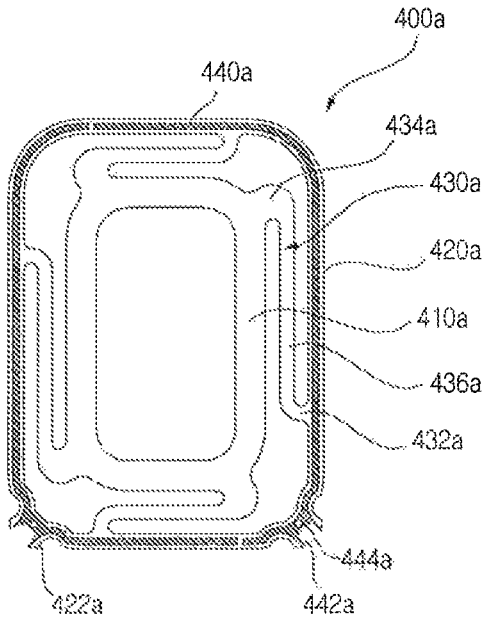
FIG. 4 is a view showing an FPCB pattern on the top side of a damper for a high-output microspeaker according to the first embodiment of the present invention.
Figure 5:
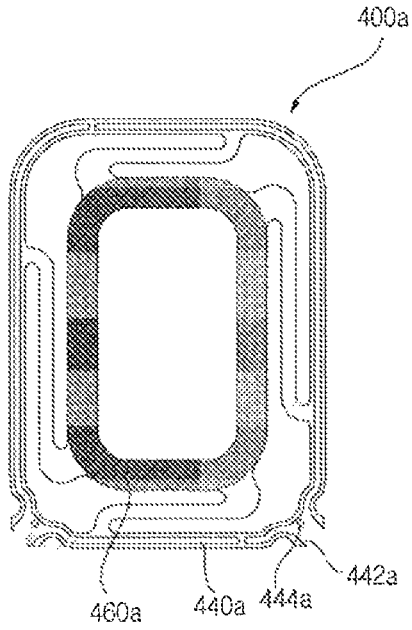
FIG. 5 is a view showing the shape of the top side of the damper for the high-output microspeaker according to the first embodiment of the present invention.
Figure 6:
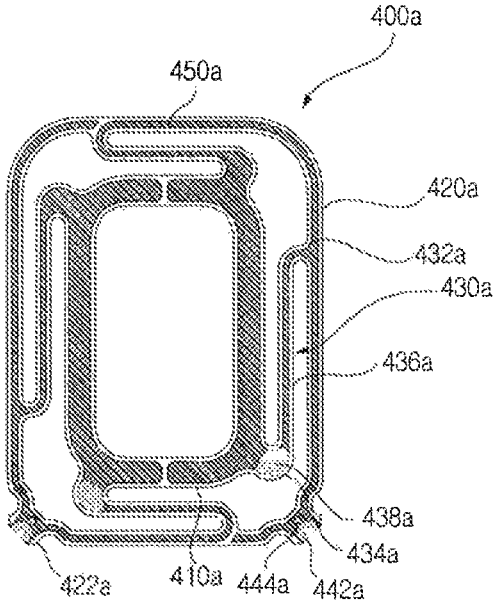
FIG. 6 is a view showing an FPCB pattern on the bottom side of the damper for the high-output microspeaker according to the first embodiment of the present invention.
Figure 7:
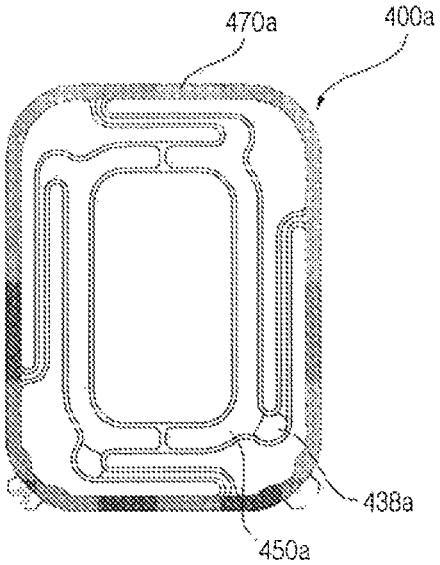
FIG. 7 is a view showing the shape of the bottom side of the damper for the high-output microspeaker according to the first embodiment of the present invention.

FIG. 4 is a view showing an FPCB pattern on the top side of the damper for the high-output microspeaker according to the first embodiment of the present invention, FIG. 5 is a view showing the shape of the top side of the damper for the high-output microspeaker according to the first embodiment of the present invention, FIG. 6 is a view showing an FPCB pattern on the bottom side of the damper for the high-output microspeaker according to the first embodiment of the present invention, and FIG. 7 is a view showing the shape of the bottom side of the damper for the high-output microspeaker according to the first embodiment of the present invention.

The damper 400*a* according to the first embodiment includes an inner portion 410*a* to which a center diaphragm, a side diaphragm and a voice coil are attached, an outer portion 420*a* being in contact with a frame and a protector, and support portions 430*a* connecting and supporting the inner portion 410*a* and the outer portion 420*a*. Also, connecting portions 422*a* for connecting to terminals such as pad type terminals 900 are provided on one side of the outer portion 420*a*. The damper 400*a* is overall in the shape of a rectangle, and its corners are rounded. The outer portion 420*a* has a rectangular shape with corners rounded along the shape of the damper 400*a* and includes four sides, and the inner portion 410 likewise has a rectangular shape with rounded corners and includes four sides. Since the side diaphragm 520 and the voice coil 300 should be attached to the bottom of the inner portion 410*a*, the width of the inner portion 410*a* should be greater than the sum of the width of the seating portion of the side diaphragm 520 and the width of the seating portion of the voice coil 300. A total of four support portions 430*a* are provided on each side, each of which includes two ends connected to one side of the outer portion 420*a* and one side of the inner portion 410*a*, respectively. Each support portion 430*a* includes an outer curved portion 432*a* meeting the outer portion 420*a* and formed in a curve, an inner curved portion 434*a* meeting the inner portion 410*a* and formed in a curve, and a linear portion 436*a* formed as a straight line between the outer curved portion 432*a* and the inner curved portion 434*a*. The outer curved portion 432*a* and the inner curved portion 434*a* are made thicker in width than the linear portion 436*a* because they receive more stress than the linear portion 436*a*; especially, the inner curved portion 434*a* is made thick. The connecting portions 422*a* are formed at both ends of one side of the outer portion 420*a*, i.e., on the corners of one side of the outer portion 420*a*, and are projected further than the corners where the connecting portions 422*a* are not formed. Referring to FIG. 4, an FPCB upper surface pattern 440*a* is formed only at the outer portion 420*a* on the top side of the damper 400*a*. The FPCB upper surface pattern 440*a* formed on the top side of the damper 400*a* is formed all over the outer portion 420*a* along the outer portion 420*a* and is divided into two sections for transmitting (+) signals and (−) signals, respectively. Each section of the FPCB upper surface pattern 440*a* includes one connecting portion 422*a*. Land portions 442*a* for bonding to the terminals 900 are provided at ends of the FPCB upper surface pattern 440*a* formed at the connecting portions 422*a*. The land portions 442*a* are plated for higher conduction efficiency to the terminals 900 and have a substantially horseshoe shape. Conducting holes 444*a* are formed at the boundaries between the connecting portions 422*a* and the outer portion 420*a*, inside the land portions 442*a*, i.e., within the FPCB upper surface pattern 440*a*. The conducting holes 444*a* are of a structure for transmitting the electrical signals from the FPCB upper surface pattern 440*a* through the land portions 442*a* to an FPCB lower surface pattern 450*a*. Because the voice coil 300 is configured to be electrically connected to the FPCB lower surface pattern 450*a* formed on the bottom side of the damper 400*a*, the FPCB upper surface pattern 440*a* and the FPCB lower surface pattern 450*a* should be electrically connected so that the electrical signals transmitted from the terminals 900 are transmitted finally to the voice coil 300. Referring to FIG. 6, the FPCB lower surface pattern 450*a* is formed all over the outer portion 420*a*, the inner portion 410*a*, and the support portions 430*a*. The FPCB lower surface pattern 450*a* is likewise divided into two sections for transmitting (+) signals and (−) signals, respectively. To this end, the FPCB lower surface pattern 450*a* is configured in a way that the outer curved portion 432*a* of a support portion 430*a* in one section is spaced apart from the pattern formed at the outer portion 420*a* in the other section, and the pattern formed at the inner portion 410*a* in one section is spaced apart from the pattern formed at the inner portion 410*a* in the other section. Meanwhile, land portions 438*a* for soldering or welding the FPCB lower surface pattern 450*a* and the voice coil 300 are provided at the support portions 430*a*, more particularly, at the inner curved portions 434*a* of the support portions 430*a*. The contours of the land portions 438*a* are wholly formed in a curve so as to prevent the land portions 438*a* from breaking easily. The land portions 438*a* are plated with silver for higher conduction efficiency.

The shape of the damper 400*a* will be discussed in more detail. The damper 400*a* is overall in the shape of a rectangle and includes four sides, with one support portion 430*a* formed on each side. The positions at the outer portion 420*a* where the support portions 430*a* are attached are inclined to one side of the center, all in the same direction on the four sides. Also, the positions at the inner portion 410*a* where the support portions 430*a* are attached are inclined to one side of the center in a direction opposite to the direction of the support portions 430*a* at the outer portion 420*a*. In addition, the damper 400*a* has a rectangular shape, with two shorter sides and two longer sides. Hereinbelow, the shorter sides are referred to as the short axis, and the longer sides are referred to as the long axis. In an embodiment, gaps between one of the two divided sections of the FPCB lower surface pattern 450*a* and the other section exist on the short axis. As gaps exist on the short axes of both the outer portion 420*a* and the inner portion 410*a*, the FPCB pattern is divided into two sections. As explained above, an outer curved portion 432*a* in one section of the FPCB pattern is spaced apart from the FPCB pattern formed at the outer portion 420 in the other section, which causes the FPCB pattern formed at the outer curved portions 432*a* of the support portions 430*a* located on the short axis to form a U-shaped curve. The FPCB lower surface pattern 450*a* formed on the bottom side of the damper 400*a* is almost the same shape as the damper 400*a*, except for the presence of the land portions 438*a* or the gaps. Accordingly, the FPCB lower surface pattern 450*a*, formed on the inner curved portions 434*a* to which stress is concentrated, likewise has a large width and therefore does not break easily, thereby increasing the reliability of the high-output microspeaker. Further, the FPCB lower surface pattern 450*a* formed on the outer curved portions 432*a* located on the long axis also has a large width and does not break easily, and the FPCB pattern formed at the outer curved portions 432*a* located on the short axis does not break easily, although its width is not large, because it is in the shape of a U-shaped curve.

Referring to FIG. 5, it can be found that an adhesive tape 460*a* is attached to the inner portion 410*a* in order to attach the center diaphragm 510 and the damper 400*a*. Referring to FIG. 7, it can be found that an adhesive tape 470*a* is attached to the outer portion 420*a* in order to attach the side diaphragm 520, the frame 100, and the damper 400*a*.

Figure 8:
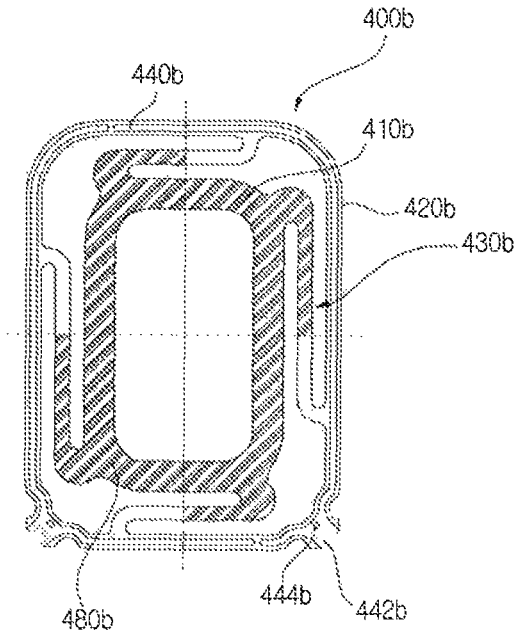
FIG. 8 is a view showing a damper for a high-output microspeaker according to a second embodiment of the present invention.

FIG. 8 is a view showing a damper for a high-output microspeaker according to a second embodiment of the present invention. The second embodiment is identical to the first embodiment, except that a cover layer 480*b* for protecting a damper 400*b* is attached on the top layer of the damper 400*b*. The cover layer 480*b* is formed in stress-concentrated regions, and the cover layer 480*b* is removed from regions where little stress is applied, so as to reduce the weight of the damper 400*b*. The cover layer 480*b* is attached to the regions of the damper 400*b* that receive the most stress, including an inner portion 410*b*, to which the voice coil 300 is attached, and inner curved portions 434*b* of support portions 430. The cover layer 480*b* is attached to both the top and bottom sides of the damper 400*b* and functions to protect the FPCB pattern and receive the stress applied to the damper 400*b*.

Figure 9:
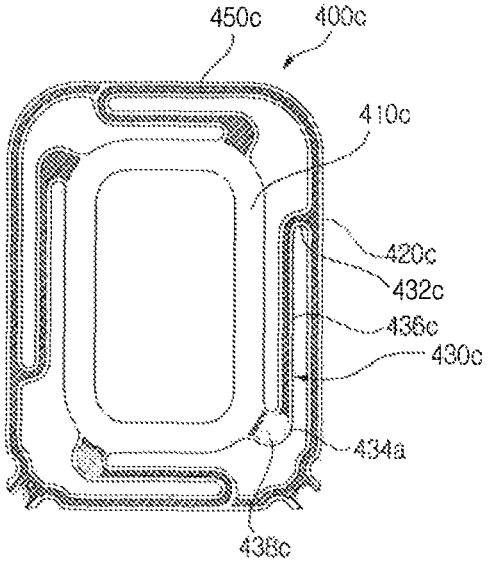
FIG. 9 is a view showing a damper for a high-output microspeaker according to a third embodiment of the present invention.

FIG. 9 is a view showing a damper for a high-output microspeaker according to a third embodiment of the present invention. The third embodiment is identical to the second embodiment, except for the shape of an FPCB lower surface pattern, so descriptions of components other than the FPCB lower surface pattern will be omitted.

In a damper 400*c* according to the third embodiment, an FPCB lower surface pattern 450*c* is formed only at an outer portion 420*c* and support portions 430*c*, but not at an inner portion 410*a*. While land portions 438*c* are formed only at two of the support portions 430*c*, the FPCB lower surface pattern 450*c* is formed at all the support portions 430*c* in order to form a symmetrical structure. That is, a dummy pattern is formed at two of the support portions 430*c*. The FPCB lower surface pattern 450*c* is configured such that the pattern width is somewhat larger at the boundaries between the regions formed on inner curved portions 434*a* of the support portions 430*c* and the inner portion 410*a*.

Figure 10:
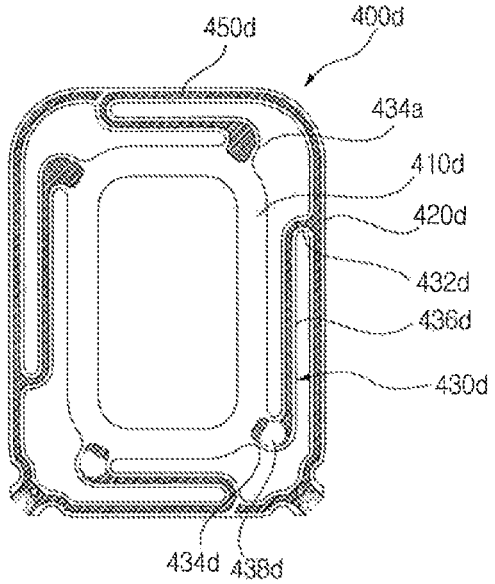
FIG. 10 is a view showing a damper for a high-output microspeaker according to a fourth embodiment of the present invention.

FIG. 10 is a view showing a damper for a high-output microspeaker according to a fourth embodiment of the present invention. The fourth embodiment is identical to the second and third embodiments, except for the shape of an FPCB lower surface pattern, so descriptions of components other than the FPCB lower surface pattern will be omitted. Like the third embodiment, in a damper 400*d* according to the fourth embodiment, an FPCB lower surface pattern 450*d* is formed only at an outer portion 420*d* and support portions 430*d*, but not at an inner portion 410*d*. Also, like the third embodiment, land portions 438*d* and an FPCB pattern for connecting to the land portions 438*d* are formed at two of the support portions 430*d*, and a dummy pattern for forming a symmetrical structure is formed at the other two support portions 430*d*. The FPCB lower surface pattern 450*c* is different from that of the third embodiment in that the regions formed on inner curved portions 434*d* of the support portions 430*d* are slightly further extended toward the inner portion 410*d* and become narrower toward the inner portion 410*d*, as compared to the third embodiment.

Figure 11:
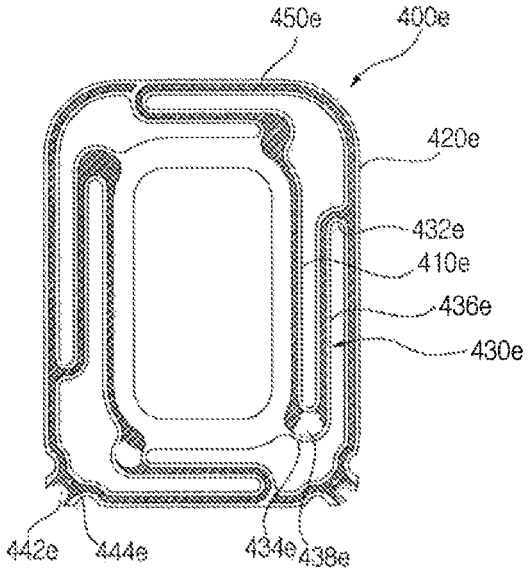
FIG. 11 is a view showing a damper for a high-output microspeaker according to a fifth embodiment of the present invention.

FIG. 11 is a view showing a damper for a high-output microspeaker according to a fifth embodiment of the present invention. The fifth embodiment is identical to the second to fourth embodiments, except for the shape of an FPCB lower surface pattern, so descriptions of components other than the FPCB lower surface pattern will be omitted. An FPCB lower surface pattern 450*e* according to the fifth embodiment is formed in some part of an inner portion 410*e*, an outer portion 420*e*, and support portions 430*e*. Also, land portions 438*e* and an FPCB pattern for connecting to the land portions 438*e* are formed at two of the support portions 430*e*, and a dummy pattern for forming a symmetrical structure is formed at the other two support portions 430*e*. As explained above, the FPCB lower surface pattern 450*e* according to the fifth embodiment is likewise divided into two sections for transmitting (+) signals and (−) signals, respectively. Each section is provided with one FPCB pattern for connecting to the land portions 438*e* and one dummy pattern. In this case, an end of the dummy pattern in each section and an end of the FPCB pattern for connecting to the land portions 438*e* are extended toward the inner portion 410*e* and connected to each other. The regions extending toward the inner portion 410*e* are formed partially on the outer side of the inner portion 410*e* along the long axis.

Figure 12:
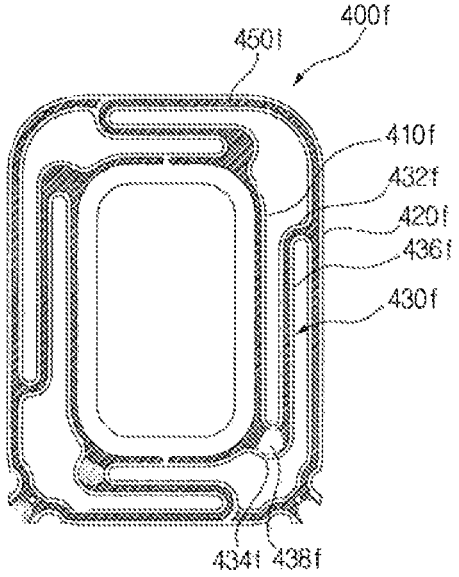
FIG. 12 is a view showing a damper for a high-output microspeaker according to a sixth embodiment of the present invention.

FIG. 12 is a view showing a damper for a high-output microspeaker according to a sixth embodiment of the present invention. The sixth embodiment is identical to the second to fifth embodiments, except for the shape of an FPCB lower surface pattern, so descriptions of components other than the FPCB lower surface pattern will be omitted. An FPCB lower surface pattern 450*f* according to the sixth embodiment is almost identical to that of the second embodiment, but different from the second embodiment in that an FPCB pattern is formed partially on the outer side of an inner portion 410*f* but not on the inner side thereof. In other words, the FPCB pattern formed at the inner portion 410*f* is narrower than that of the second embodiment.

What is claimed is:

1. A high-output microspeaker, comprising:

a frame;

a protector;

a yoke assembly coupled to the frame and including a magnet;

a diaphragm provided in the frame and producing vibration;

a voice coil coupled to the diaphragm and vibrating the diaphragm;

a terminal provided on one side of the frame and providing an electrical connection between the lead wire of the voice coil and an external terminal; and a damper made of a flexible printed circuit board (FPCB) and including an inner portion to which a center diaphragm, a side diaphragm and the voice coil are attached, an outer portion to which the side diaphragm is attached and which is in contact with the frame and the protector, a support portion functioning to connect the outer portion and the inner portion and including a land portion to which the lead-in wire of the voice coil is soldered or welded, and a connecting portion extending outward from the outer portion and providing an electrical connection between the terminal provided on the frame and the outer portion, wherein a cover layer is formed in stress-concentrated regions of the flexible printed circuit board (FPCB) pattern of the damper.

2. The high-output microspeaker as claimed in claim 1, wherein the terminal and the connecting portion are located on a corner of the frame, two or more projections for supporting the connecting portion are provided on the corner where the terminal and the connecting portion are located, and the connecting portion has a shape fitting to the projections.

3. The high-output microspeaker as claimed in claim 1, wherein the connecting portion comprises a horseshoe-shaped land portion for soldering or welding.

4. The high-output microspeaker as claimed in claim 3, wherein the horseshoe-shaped land portion is formed on at least one of the top and bottom sides of the damper.

5. The high-output microspeaker as claimed in claim 3, wherein the horseshoe-shaped land portion is formed on the bottom side of the damper, and a through hole for transmitting electrical signals to a flexible printed circuit board (FPCB) pattern formed on the top side of the damper is formed at the boundary between the connecting portion and the outer portion.

6. The high-output microspeaker as claimed in claim 1, wherein a flexible printed circuit board (FPCB) pattern at the support portion is formed on either the top side or bottom side of the damper, and a flexible printed circuit board (FPCB) pattern at the outer portion is formed on both the top and bottom sides of the damper.

7. The high-output microspeaker as claimed in claim 1, wherein the inner portion has no FPCB pattern of the damper.

8. The high-output microspeaker as claimed in claim 1, wherein the support portion has an FPCB pattern for soldering or welding the lead-in wire of the coil, and the flexible printed circuit board (FPCB) pattern at the support portion includes a dummy pattern for forming a symmetrical structure.

9. The high-output microspeaker as claimed in claim 1, wherein the high-output microspeaker is formed in a rectangular shape, and the support portion is formed on four edges.

10. The high-output microspeaker as claimed in claim 9, wherein the support portion comprises an outer curved portion, a linear portion and an inner curved portion and is connected from the outer portion to the inner portion.

11. The high-output microspeaker as claimed in claim 10, wherein the width of the curved portions is greater than the width of the linear portion.

12. The high-output micro speaker as claimed in claim 10, wherein the outer curved portion is inclined to one side of the center of the edge.

13. The high-output microspeaker as claimed in claim 1, wherein the flexible printed circuit board (FPCB) pattern of the damper includes a pair of sections, each including two neighboring support portions, and the curved portion of any one of the two support portions is spaced apart from the outer portion of the other section of the flexible printed circuit board (FPCB) pattern.

14. The high-output microspeaker as claimed in claim 1, wherein the width of the inner portion is greater than the sum of the size of a seating portion of the side diaphragm and the size of the attachment portion of the voice coil.

15. The high-output microspeaker as claimed in claim 1, wherein the contour of the land portion formed at the support portion is entirely in the shape of a curve.

* * * * *